US005993138A

United States Patent [19]

Anderson et al.

[11] Patent Number: 5,993,138

[45] Date of Patent: *Nov. 30, 1999

[54] TILT LINKAGE ARRANGEMENT

[75] Inventors: Robert S. Anderson, Garner; Jeffrey A. Deneve; Owen S. Loughrin, both of Sanford, all of N.C.

[73] Assignee: Caterpillar Inc., Peoria, Ill.

[ * ] Notice: This patent is subject to a terminal disclaimer.

[21] Appl. No.: 09/048,187

[22] Filed: Mar. 25, 1998

Related U.S. Application Data

[60] Provisional application No. 60/051,253, Jun. 30, 1997.

[51] Int. Cl.[6] ..... B66C 23/00

[52] U.S. Cl. ..... 414/706; 414/697

[58] Field of Search ..... 414/697, 700–715

[56] References Cited

U.S. PATENT DOCUMENTS

| | | | |
|---|---|---|---|
| D. 323,168 | 1/1992 | Ericsson | D15/32 |
| 3,648,871 | 3/1972 | Layton . | |
| 3,871,538 | 3/1975 | Miller et al. | 414/705 |
| 4,239,444 | 12/1980 | Schmelzer | 414/685 |
| 4,768,917 | 9/1988 | Garman | 414/697 |
| 4,776,750 | 10/1988 | Griswold et al. | 414/698 |
| 5,111,578 | 5/1992 | Ball et al. | 29/891 |
| 5,152,659 | 10/1992 | Waka | 414/722 |
| 5,400,531 | 3/1995 | Brown | 37/468 |
| 5,595,471 | 1/1997 | Ajilore | 414/685 |
| 5,599,158 | 2/1997 | Ajilore | 414/685 |
| 5,611,656 | 3/1997 | Davis et al. | 414/694 |

FOREIGN PATENT DOCUMENTS

| | | | |
|---|---|---|---|
| 962233 | 2/1975 | Canada | 214/46 |
| 2418840 | 9/1979 | France | E02F 3/04 |
| 1252080 | 10/1967 | Germany | 414/708 |
| 1456538 | 1/1969 | Germany | 337/37 |
| 4211078A1 | 10/1993 | Germany | D02F 3/43 |
| 3-180628 | 8/1991 | Japan | E02F 9/14 |

OTHER PUBLICATIONS

Ledinger, Gustav, "New Universal Geometry for Wheeled Loaders" Industrial Vehicle Technology—996: 41–44.

PCT Publication WO 90/06403 dated Jun. 14, 1990 "A Linkage system for Loading Machines".

*Primary Examiner*—Donald W. Underwood
*Attorney, Agent, or Firm*—Diana L. Charlton

[57] ABSTRACT

In the operation of a wheel loader, the linkage arrangement that mounts the bucket to the machine must provide components with adequate loading capabilities while maintaining good visibility to the bucket for an operator. The present linkage arrangement includes a tilt lever with a pair of spaced side walls and a tilt link with a pair of spaced side rails. Each spaced side rail of the tilt link has a pair of legs, respectively, which straddle one of the pair of spaced side walls of the tilt lever in a connection which improves visibility while possessing superior strength capabilities.

11 Claims, 2 Drawing Sheets

TILT LINKAGE ARRANGEMENT

CROSS REFERENCE TO RELATED APPLICATIONS

This application is based, in part, on the material disclosed in U.S. provisional patent application Ser. No. 60/051,253 filed Jun. 30, 1997.

TECHNICAL FIELD

This invention relates generally to a linkage arrangement and more particularly to a wheel loader linkage having components that are configured to increase load capacity and visibility and to ensure uniform lift.

BACKGROUNG ART

Present construction machines, such as wheel loaders, typically include slab lift arms.

Occasionally, a box boom lift arm is used which is mounted to the machine. A tilt linkage is mounted to the box boom lift arm for pivoting a work implement in respect to the box boom lift arm.

During operation of the wheel loader, the tilt linkage is subjected to various loads and forces, some of which may be severe. Therefore, it is critical that each component thereof has sufficient structure and connection to one another to provide the strength necessary to withstand these loads and forces while limiting the weight so as to not affect overall machine performance. The strength requirements for each of the components are coupled with the need to increase visibility for an operator of the machine and performance of the tilt linkage.

One such design is disclosed in U.S. Pat. No. 4,643,631 issued to Herman J. Maurer et al. on Feb. 17, 1987 which describes a non-parallel linkage arrangement configured such that a first link, second link and tilt cylinder are connected at the same pin joint at outer distal ends of the first and second links. This connection limits visibility by reducing the amount of clearance between the first and second links due to the coincident connection of the tilt cylinder.

Designs for excavators may also include linkage arrangements to connect a bucket to the machine, such as that disclosed in French Pub. 2 418 840 issued to Daniel D. Baconet et al. on Feb. 11, 1979, which describes a pivotal bucket for an excavator which includes a idler link with a pair of spaced side walls, a power link consisting of two separate members connected at a distal end of the idler link to define a pair of spaced pin joints and a tilt cylinder connected elevationally below the pair of spaced pin joints. Unfortunately, if used on a wheel loader, the connection of the power link members to the idler link between the spaced side walls within the created clearance would lower visibility to an unacceptable level. Additionally, the separate members of the power link lower the load capability of the linkage arrangement especially during side loading due to the available movement therebetween.

The present invention is directed to overcoming the problems as set forth above.

DISCLOSURE OF THE INVENTION

In one aspect of the present invention, a linkage arrangement for mounting a work implement to a construction machine having a frame is provided. The linkage arrangement includes a first link pivotally mounted to the frame at a first end portion and pivotally connected to the work implement at a second end portion. The first link is moveable in a general vertical plane with respect to the construction machine. A second link is pivotally connected at a first end portion to the first link at a first pin joint. The second link has a pair of spaced side walls. A third link is provided that has a pair of interconnected spaced side rails. The third link is pivotally connected at a first end portion to a second end portion of the second link at spaced, separate second and third pin joints corresponding to a respective one of the pair of spaced side walls of the second link and is pivotally connected at a second end portion to the work implement. Means for pivoting the work implement with respect to the first link is provided. The pivoting means is pivotally connected to the frame at a first end and pivotally connected to the second link at a second end.

In another aspect of the present invention, a tilt linkage arrangement for controlling a work implement mounted to a wheel loader through a centrally disposed box boom lift arm assembly is provided that is capable of movement in a general vertical plane in respect to the wheel loader. The tilt linkage arrangement includes a tilt lever that has a pair of interconnected spaced side walls. A tilt link is provided that has a pair of interconnected side rails connected to the tilt lever at spaced, separate second and third pin joints. A tilt cylinder is pivotally connected to the wheel loader at a first end and is pivotally connected to the tilt lever at a second end to allow pivoting of the work implement with respect to the box boom lift arm assembly.

The present invention includes a tilt lever with interconnected spaced side walls and a tilt link with interconnected spaced side rails being pivotally connected together to define a pair of spaced, separate pin joints. The interconnection of the spaced side walls and side rails of the tilt lever and tilt link, respectively, and the connection of the tilt link to the tilt lever increase the performance of the linkage arrangement and visibility for an operator without an increase in weight to the machine.

BEST MODE FOR CARRYING OUT THE INVENTION

Figure 1:
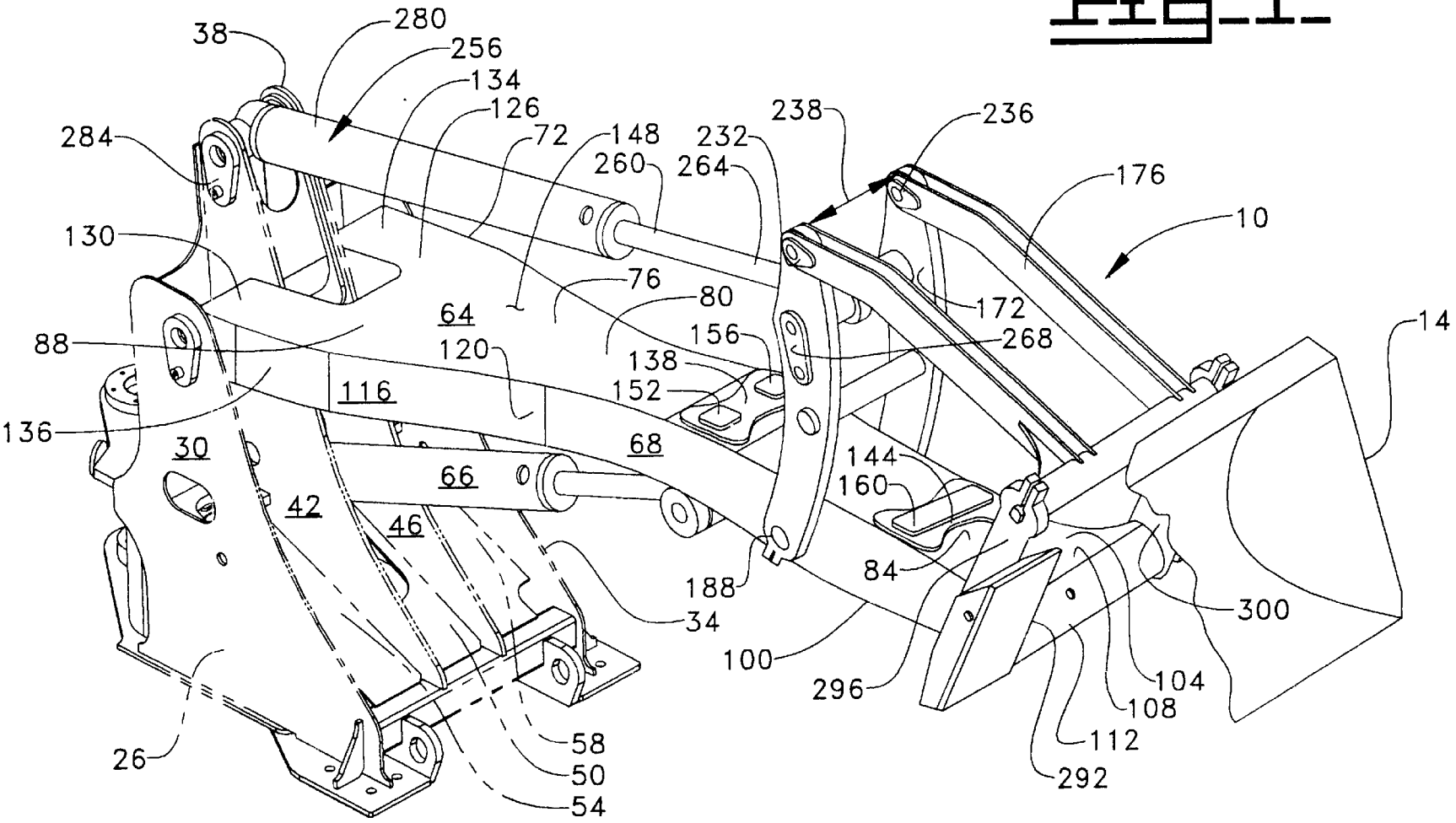
FIG. 1 is an isometric view of a linkage arrangement embodying the present invention connected to a boom mechanism.
Figure 2:
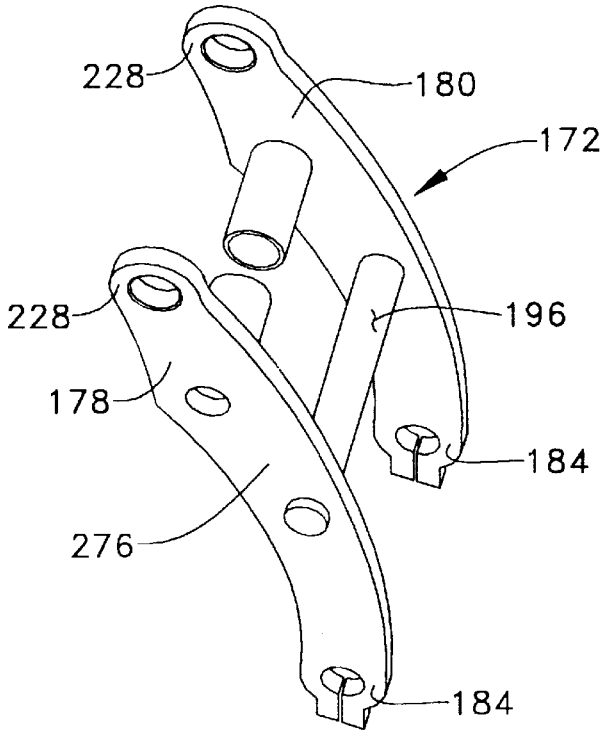
FIG. 2 is an isometric view of a tilt lever of the linkage arrangement shown in FIG. 1.
Figure 3:
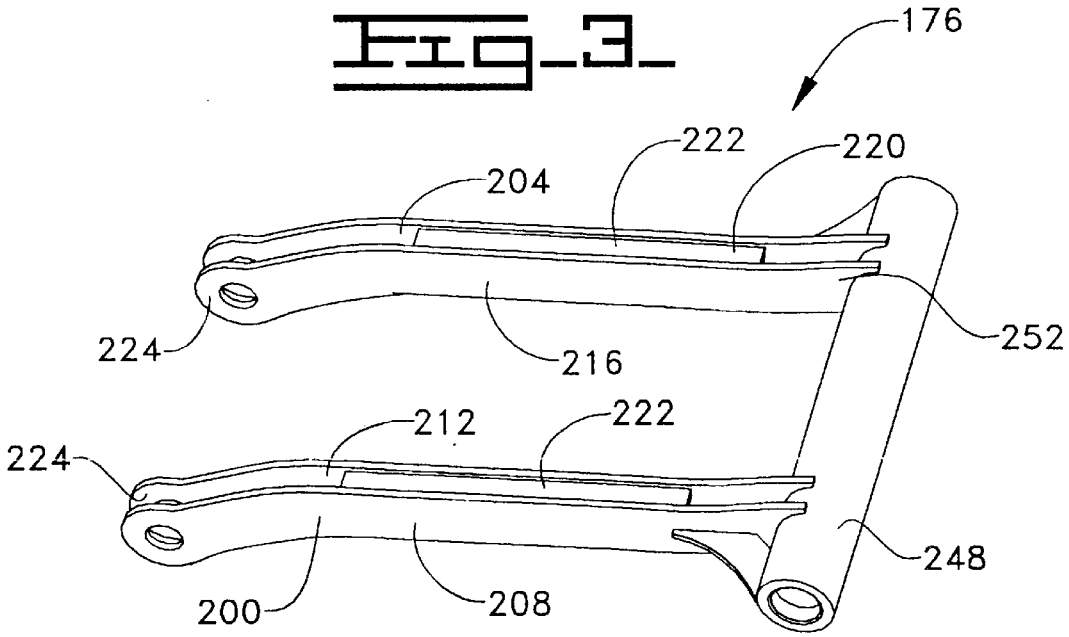
FIG. 3 is an isometric view of a tilt link of the linkage arrangement shown in FIG. 1.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to the drawings, it can be seen that a linkage arrangement 10 is disclosed for a work implement 14 which is mounted to a construction machine (not shown), such as a wheel loader. It should be understood that although the work implement shown in FIG. 1 is a bucket commonly used in conjunction with a wheel loader that any one of a number of different tools may be used. It should also be understood that the linkage arrangement may be used on any type of construction machine.

The wheel loader has a non-engine end frame 26 which is connected to the engine end frame (not shown). It should be understood that, although a non-engine end frame is shown and described, the invention may be used directly with a unitary frame wheel loader (not shown). The non-engine end frame 26 includes a pair of outer side wall portions 30,34 and a central tower portion 38 with a pair of inner side wall portions 42,46 positioned to define an interior space 50 therebetween. Each one of the pair of inner side wall portions is spaced from one of the pair of outer side wall portions 30,34 to define a pair of exterior spaces 54,58.

The linkage arrangement 10 includes a first link 64 in the form of a box boom lift arm assembly that is directly positioned between the non-engine end frame 26 and the work implement 14. The box boom lift arm assembly 64 is connected to the non-engine end frame 26 in any suitable manner, such as through a pair of conventional pin joints. The box boom lift arm assembly 64 is substantially positioned on a vertical plane that is coincident with a centerline defined by the construction machine (not shown). The box boom lift arm assembly 64 is moved along the vertical plane by a lift cylinder 66 in a well know manner.

The box boom lift arm assembly 64 has a pair of spaced inner side walls 68,72, each constructed from a single sheet of plate steel or any other suitable type of material. A top wall 76 is formed in any suitable manner to achieve substantially the same length of the spaced inner side walls 68,72 and includes a central portion 80, a first end portion 84 diverging outwardly from the central portion 80 and a bifurcated second end portion 88 opposite the first end portion 84 diverging outwardly from the central portion 80 in a substantial U-shape. The top wall 76 is constructed from single piece plate steel or from any other suitable type of material. The top wall 76 is fixedly connected to the spaced inner side walls 68,72 through a continuous non-transverse weld substantially along the entire length of the spaced inner side walls 68,72. A bottom wall 100 is constructed with similar portions as the top wall 76 except the bottom wall 100 is constructed from a pair of plate steel members instead of single piece plate steel. The bottom wall 100 is fixedly connected to the pair of spaced inner side walls 68,72 through a continuous non-transverse weld substantially along the entire predetermined length of the spaced inner side walls 68,72. The connection of the top and bottom walls 76,100 to the pair of inner side walls 68,72 defines a coupler end portion 104 at a first end 108 of the box boom lift arm assembly 64. A tubular boss 112 made from any suitable material, such as steel, is welded to the box boom lift arm assembly 64 at the coupler end portion 104 and extends beyond the width thereof. A pair of outer side walls, one of which is shown at 116, are constructed from single piece plate steel or any other suitable material. The pair of outer side walls 116 each have a substantial U-shape corresponding to the U-shape of the bifurcated second end portions 88 of the top and bottom walls 76,100. Each of the pair of outer side walls 116 are welded to a respective one of the pair of inner side walls 68,72 at a first end, one of which is shown at 120, and are fixedly connected to the top and bottom walls 76,100 through a continuous non-transverse weld extending substantially along the length of the outer side walls 116. The connection of the pair of outer side walls 116 with the bifurcated second ends 88 of the top and bottom walls 76,100 defines a bifurcated end portion 126 with a pair of legs 130,134 at a second end 136 opposite the coupler end portion 104. It should be understood that although the top wall, inner side walls and outer side walls of the box boom lift arm assembly are constructed from single piece plate steel and the bottom wall is constructed from a pair of plate steel members all of which are welded substantially with non-transverse welds for enhanced fatigue characteristics, the parts could be made in any of a number of ways, such as casting or welding the entire box boom lift arm assembly. Spaced rack and dump plates 138,144 are welded to a top surface 148 of the top wall 76. The rack plate 138 has a pair of spaced outward projections 152,156 and the dump plate 144 has an outward projection 160 which act as stop pads. The outward projection 160 of the dump plate 144 has a length which extends substantially across the dump plate 144 approximately equal to the distance of the outward projections 152,156. Each of the outward projections 152, 156,160 are elevated above the top surface 148 of the top wall 76. The outward projections 152,156,160 of the rack and dump plates 138,144 are located at separate, predetermined locations, respectively, on the top surface 148. The rack and dump plates 138,144 are positioned in relation to a specified portion of a minimum and maximum lift operation range corresponding to a preselected angle of the bucket 14 created during a minimum and maximum tilt operation range. It should be understood that although the rack and dump plates 138,144 are shown in separate locations, it would be possible to attain similar results from a single plate location on the top wall with minor variations in the design. It should also be noted that the outward projections 152, 156,160 of the rack and dump plates 138,144, respectively, may include single or double stop pads or any combination thereof without diverting from the scope of the invention.

The bucket 14 is pivoted in respect to its mounting by a second and third link 172,176, respectively, in the form of a tilt lever and a tilt link positioned between the bucket 14 and the box boom lift arm assembly 64. The tilt lever 172 has a pair of curved spaced side walls 178,180 with a length of approximately 0.3 to 0.5 the length of the box boom lift arm assembly 64. A portion of the spaced side walls 178,180 straddle the top wall 76 and inner side walls 68,72 of the box boom lift arm assembly 64. Each one of the pair of spaced side walls 178,180 of the tilt lever 172 is pivotally connected at a first end portion 184 to one of the pair of inner side walls 68,72 of the box boom lift arm assembly 64 at a pin joint 188. The pin joint 188 includes a pin (not shown) extending through the spaced side walls 178,180 and inner side walls 68,72 and is connected to the box boom lift arm assembly 64 in a well known manner. The tilt lever 172 has a solid bar 196 fixedly interconnecting the spaced side walls 178,180 and extending therebetween. The bar 196 is located at a position along the length of the spaced side walls 178,180 for contacting the outward projections 152,156,160 of the rack and dump plates 138,144 during the specified portion of the respective minimum and maximum lift and tilt operation ranges.

The tilt link 176 has a pair of spaced side rails 200,204 and each side rail 200,204 has a length of approximately 0.2 to 0.4 the length of the box boom lift arm assembly 64. A pair of spaced legs 208,212,216,220, respectively, are angled at a specified location along the length thereof. The spaced legs 208,212,216,220 are interconnected through a stabilizing segment 222. One of the pair of spaced legs 208,212,216,220 straddle one of the pair of spaced side walls 200,204 of the tilt lever 172 and is pivotally connected at a first end 224 to a second end 228 of the tilt lever 172 through a pair of separate pin joints 232,236. The pair of pin joints 232,236 include a pair of pins (not shown). Each of the pair of pins (not shown) extend through the respective spaced legs 208,212,216,220 and spaced side walls 200,204 in a well known manner to define a substantially unobstructed clearance space 238 with a width substantially equal to the width of the central portion 80 of the box boom lift arm assembly 64 between the pair of pin joints 232,236. A tubular boss 248 is welded to fixedly interconnect the spaced side rails 200,204 at a second end 252 of the tilt link 176 and extends therebetween at a length of approximately 1.8 to 2.2 the width of the central portion 80 of the box boom lift arm assembly 64. The length of the tubular boss 248 is greater than the clearance space 238 between the pair of pin joints 232,236.

A means 256 for pivoting the bucket 14 with respect to the box boom lift arm assembly 64 is provided in the form of a tilt cylinder 260. The tilt cylinder 260 is pivotally connected at a first end 264 to the tilt lever 172 at a pin joint 268 located remotely from pin joints 232,236,188. The pin joint 268 includes a pin (not shown) which extends between spaced side walls 178,180 of the tilt lever 172 through the first end 264 of the tilt cylinder 260 in a well known manner. The pin joint 268 is positioned between the pair of pin joints 232,236 and the pin joint 188 above the tilt lever bar 196 substantially above a central portion 276 of the tilt lever 172. The pin joints 232,236, the pin joint 268 and the pin joint 188 are all substantially co-linearly aligned on the tilt lever 172. A second end 280 of the tilt cylinder 260 is pivotally connected to the end frame 26 within the interior space 50 of the central tower portion 38 between the inner side wall portions 42,46 through a pin joint 284. The pin joint 284 is positioned approximately 0.1 to 0.2 times the length of the box boom lift arm assembly 64 above the pair of pin joints connecting the box boom lift arm assembly 64 to the non-engine end frame 26 and may be positioned substantially co-linearly therewith or therebehind. The pin joint 284 includes a pin (not shown) which extends through the inner side wall portions 42,46 through the second end 280 of the tilt cylinder 260 and is connected to the inner side wall portions 42,46 in a well known manner.

It should be noted that all dimensions and references thereof are given for perspective purposes only and may vary dependent on the machine or circumstances in which the invention is used.

A hydraulic tool coupler 292 of any suitable type is connected at first and second ends 296,300 to the tubular bosses 112,248 at the coupler end portion 104 of the box boom lift arm assembly 64 and the tilt link 176, respectively, for pivotally connecting the bucket 14 to the linkage arrangement 10. It should be understood that although a hydraulic tool coupler is described for use with the present invention, the linkage arrangement may be directly connected to the work implement without any specific coupling devices.

INDUSTRIAL APPLICABILITY

Although the operation of a wheel loader normally includes the excavation of material from the ground or pile and the dumping of the material in a nearby truck or movement to a remote site, various other operations are available dependent on the tool utilized. Under operation with the bucket 14, it is loaded primarily under the motive force of the wheel loader as it is forced into the pile of material. The bucket is simultaneously lifted through extension of a lift cylinder and rotated toward the wheel loader, or racked back, from the minimum to a maximum tilt operation range by the retraction of the tilt cylinder 260. In the event that the material is to be dumped into the truck, it is crucial that the bucket angle is controlled at a portion of the minimum and maximum lift operation range. The bucket angle at a portion of the minimum lift operation range must be sufficient to provide an adequate turning radius for the machine while the bucket angle at a portion of the maximum lift operation range must be sufficient to dump substantially all the material into the truck. This is accomplished through the mechanical rack and dump stops 138,144 on the top surface 148 of the top wall 76 of the box boom lift arm assembly 64. The tilt lever 172 was designed so that sufficient material was provided for incorporation of the bar 196. The bar 196 and the outward projections 152,156 on the rack stop 138 are positioned for contact when the bucket 14 reaches a preselected angle with respect to the ground at a portion of the minimum lift operation range. The bar 196 on the tilt lever 172 and the outward projections 160 on the dump stop 144 are positioned for contact when the bucket 14 reaches a preselected, negative angle with respect to the ground at a portion of the maximum lift operation range. The position of the rack and dump stops 138,144 on the top wall 76 provides a larger area for the dispersion of the impact loads as compared to cantilevered stops typically used in wheel loader linkages It should be noted that should only one plate be used for the rack and dump stop, other structure may be used in place of or in operation with the bar 196 for contact with the plate to provide similar functionability.

It is well known that the loads and forces on the linkage arrangement 10 can be extremely severe dependent on various factors of operation, making it imperative to increase strength and loading capabilities of all the components. The bar 196 and the tubular boss 248 provide additional strength for lateral and torsional loads across the tilt lever 172 and tilt link 176, respectively, especially during side loading. To add stability and strength to the spaced side rails 200,204, the segments 222 have been included along a portion of the length. Clamping the tilt lever 172 to the pin (not shown) through the box boom lift arm assembly 64 provides for torsional rigidity.

Additionally, during operation of various tools, such as a bucket, and/or coupling operations, it is very beneficial for the operator of the wheel loader to be able to see the tool. The pivotal connection between the tilt cylinder 260 and the tilt lever 172 is placed in consideration of not only design constraints for clearance imposed by the box boom lift arm assembly 64, product requirements of mechanical self-leveling and optimal break-out performance, but also for increased visibility. This occurs, in part, due to the tilt cylinder 260 being separated from the pair of pin joints 232,236 between the tilt lever 172 and tilt link 176. Additionally, the lengths of the tilt lever 172 and tilt link 176 are such that the length ratios provide optimal linkage performance for load capacity, self-leveling and increased visibility. Additionally, the unique connection of the legs 208,212,216,220 of the tilt link 176 to the spaced side walls 178,180 of the tilt lever 172 enhances the strength capabilities within the pin joints 232,236. The removal of material creating the spacing between the legs 208,212 and 216,220 reduces the weight of the tilt link 176 while the straddling of the spaced side walls 178,180 of the tilt lever 172 with the legs 208,212,216,220 of the tilt link 176 reduces the obstruction within the clearance space 238. Both the reduction in weight of the tilt link 176 and the straddling connection of the tilt link 176 to the tilt lever 172 occurs without a loss of strength capabilities at the pin joints 232,236. The curved shape of the tilt lever 172 and tilt link 176, respectively, are such for consideration of design constraints imposed by the box boom lift arm assembly 64 and contact of the bar 196 of the tilt lever 172 across an adequate cross-section thereof. Furthermore, when the bucket is in a portion of the minimum lift operation range, the angled portion of the tilt link 176 is adjacent and in a non-contacting relationship with the pin joint 268. The location of the bend angle of the tilt link 176 in such a manner improves visibility by allowing the tilt linkage 10 to lower more closely to the box boom lift arm assembly 64.

Other aspects, objects and advantages of this invention can be obtained from a study of the drawings, disclosure and the appended claims.

We claim:

1. A linkage arrangement for mounting a work implement to a construction machine having a frame, comprising:

a first link pivotally mountable to the frame at a first end portion for movement in a general vertical plane with respect to the construction machine and pivotally connectable to the work implement at a second end portion;

a second link pivotally connected at a first end portion to the first link at a first pin joint, the second link having a pair of spaced side walls;

a third link having a pair of interconnected spaced side rails and being pivotally connected at a first portion to a second end portion of the second link at spaced, separate second and third pin joints corresponding to a respective one of the pair of spaced side walls of the second link and pivotally connectable at a second end portion to the work implement, each one of the pair of side rails having a pair of spaced legs which straddle a respective one of the pair of side walls of the second link; and means for pivoting the work implement with respect to the first link, the pivoting means pivotally connected to the second link at a first and pivotally connectable to the frame at a second end.

2. The linkage arrangement of claim 1, wherein the pivoting means is a tilt cylinder and the first end of the tilt cylinder is positioned at a spaced distance from the separate second and third pin joints and therebetween at a fourth pin joint above a central portion of the tilt lever.

3. The linkage arrangement of claim 2, wherein the fourth pin joint is positioned elevational below the separate second and third pin joints.

4. The linkage arrangement of claim 1, wherein the third link is a tilt link and the pair of spaced legs are pivotally connected to the side walls at the respective separate second and third pin joints.

5. The linkage arrangement of claim 4, wherein the second link is a tilt lever and the pair of spaced side walls of the tilt lever straddle the first link with each one of the pair of spaced side walls being pivotally connected to one of the pair of inner side walls of the first link.

6. The linkage arrangement of claim 5, wherein the pair of legs of the tilt link have a predetermined angle at a predetermined location along a predetermined length thereof and the pair of spaced walls of the tilt lever are curved.

7. The linkage arrangement of claim 6, wherein the spaced side walls of the tilt lever are interconnected by a bar extending between the pair of spaced side walls at a spaced distance from the separate second and third pin joints which is greater than the spaced distance between the fourth pin joint and the separate second and third pin joint.

8. The linkage arrangement of claim 7, wherein the bar of the tilt lever contacts a first portion of a top wall of the first link and the bend angle of the tilt link is adjacent to and in a non-contacting relationship with the fourth pin joint when the linkage arrangement is in a portion of the lowermost operating range of motion and the bar contacts a second portion of the top wall of the first link and is spaced a predetermined distance from the first portion of the top wall of the first link when the linkage arrangement is in a portion of the uppermost operating range of motion.

9. A tilt linkage arrangement for controlling a work implement mounted to a wheel loader through a centrally disposed box boom lift arm assembly capable of movement in a general vertical plane in respect to the wheel loader, comprising:

a tilt lever having a pair of interconnected spaced side walls;

a tilt link having a pair of interconnected side rails connected to the tilt lever at spaced, separate second and third pin joints, each one of the pair of side rails having a pair of spaced legs which straddle a respective one of the pair of side walls of the tilt lever; and a tilt cylinder pivotally connected to the tilt lever at a first end and pivotally connectable to the wheel loader at a second end to allow pivoting of the work implement with respect to the box boom lift arm assembly.

10. The tilt linkage arrangement of claim 9, wherein the first end of the tilt cylinder is positioned at a spaced distance from the separate second and third pin joints and therebetween at a fourth pin joint above a central portion of the tilt lever and is positioned elevationally below the separate second and third pin joints.

11. The tilt linkage arrangement of claim 10, wherein the spaced side walls of the tilt lever are interconnected by a bar extending between the pair of side walls at a spaced distance from the separate second and third pin joints which is greater than the spaced distance between the fourth pin joint and the separate second and third pin joint.

* * * * *